US006599371B2

(12) United States Patent
Madi et al.

(10) Patent No.: US 6,599,371 B2
(45) Date of Patent: Jul. 29, 2003

(54) HYDROGEN PEROXIDE PICKLING SCHEME FOR SILICON-CONTAINING ELECTRICAL STEEL GRADES

(75) Inventors: Vijay N. Madi, Fairfield, OH (US); Jerald W. Leeker, Trenton, OH (US); Clayton A. Van Scoy, Butler, PA (US)

(73) Assignee: AK Steel Corporation, Middletown, OH (US)

( * ) Notice: Subject to any disclaimer, the term of this patent is extended or adjusted under 35 U.S.C. 154(b) by 0 days.

(21) Appl. No.: 10/119,444

(22) Filed: Apr. 9, 2002

(65) Prior Publication Data

US 2002/0179113 A1 Dec. 5, 2002

Related U.S. Application Data

(60) Provisional application No. 60/282,564, filed on Apr. 9, 2001.

(51) Int. Cl.[7] ..... C23G 1/02

(52) U.S. Cl. ..... 134/3; 134/2; 134/9; 134/15; 134/19; 134/25.5; 134/26; 134/28; 134/29; 134/32; 134/34; 134/35; 134/36; 134/41; 134/42; 510/258; 510/367; 252/186.27; 252/186.28; 252/186.41; 148/713

(58) Field of Search ..... 148/713; 134/2, 134/3, 9, 15, 19, 25.5, 26, 28, 29, 32, 34, 35, 36, 41, 42; 510/258, 367; 252/186.41, 186.27, 186.28

(56) References Cited

U.S. PATENT DOCUMENTS

| | | | | |
|---|---|---|---|---|
| 3,489,625 A | | 1/1970 | Dell | 156/8 |
| 3,649,194 A | | 3/1972 | Glanville | 23/207.5 |
| 3,864,271 A | | 2/1975 | Stalter | 252/99 |
| 3,903,244 A | | 9/1975 | Winkley | 423/272 |
| 3,905,907 A | | 9/1975 | Shiga | 252/79.4 |
| 4,022,703 A | | 5/1977 | Bakes et al. | 252/100 |
| 4,051,057 A | | 9/1977 | Ericson et al. | 252/100 |
| 4,459,216 A | | 7/1984 | Nakazato et al. | 252/79.4 |
| 4,754,803 A | | 7/1988 | Escobar, Jr. et al. | 164/452 |
| 4,946,520 A | | 8/1990 | Escobar, Jr. et al. | 148/432 |
| 5,100,500 A | | 3/1992 | Dastolfo | 216/252 |
| 5,154,774 A | | 10/1992 | Bousquet et al. | 134/3 |
| 5,164,016 A | | 11/1992 | Henriet | 134/2 |
| 5,248,386 A | | 9/1993 | Dastolfo, Jr. | 156/659.1 |
| 5,292,374 A | | 3/1994 | Maresch et al. | 134/3 |
| 5,354,383 A | | 10/1994 | Bianchi | 134/3 |
| 5,417,775 A | | 5/1995 | Pedrazzini | 148/269 |
| 5,538,152 A | | 7/1996 | Fontana | 216/108 |
| 5,702,534 A | | 12/1997 | Rodabaugh et al. | 134/7 |
| 5,743,968 A | | 4/1998 | Leeker et al. | 134/2 |
| 5,785,765 A | | 7/1998 | Zavottoni | 134/2 |
| 5,810,939 A | | 9/1998 | Angel et al. | 134/2 |
| 5,812,212 A | * | 9/1998 | Hamamatsu et al. | 348/564 |
| 5,821,212 A | | 10/1998 | Peterson | 510/258 |

(List continued on next page.)

FOREIGN PATENT DOCUMENTS

| | | |
|---|---|---|
| EP | 582121 | 2/1994 |
| JP | A 2122087 | 5/1990 |
| WO | wo02081380 | * 10/2002 |
| WO | wo02081776 | * 10/2002 |
| WO | wo02081777 | * 10/2002 |

*Primary Examiner*—Sharidan Carrillo
(74) *Attorney, Agent, or Firm*—Frost Brown Todd LLC

(57) ABSTRACT

The pickling process of the present invention is designed for pickling electrical steel strip in a continuous fashion and comprises at least one pickling tank equipped with at least one set of sprayers designed to spray the top and bottom surfaces of a steel strip with a solution comprised of hydrogen peroxide prior to and/or after the strip is immersed in a solution contained in a pickling tank. The set(s) of sprayers in each of the pickling tanks are located above the level of the pickle bath solution, rather than being located in separate spray tanks. Upon exiting the final pickling tank, the strip is brushed/scrubbed to loosen any residual scale to form a clean strip.

18 Claims, 3 Drawing Sheets

U.S. PATENT DOCUMENTS

| | | | | | |
|---|---|---|---|---|---|
| 5,843,240 | A | | 12/1998 | Pedrazzini et al. | 134/3 |
| 5,904,157 | A | | 5/1999 | Meseha et al. | 134/3 |
| 5,908,511 | A | | 6/1999 | Bianchi | 134/3 |
| 5,958,147 | A | | 9/1999 | Berglind et al. | 134/3 |
| 5,992,196 | A | | 11/1999 | Giraud et al. | 72/39 |
| 6,068,001 | A | | 5/2000 | Pedrazzini et al. | 134/3 |
| 6,149,744 | A | * | 11/2000 | Fukuda et al. | 148/611 |
| 6,174,383 | B1 | | 1/2001 | Angel et al. | 134/41 |
| 6,210,491 | B1 | | 4/2001 | Colgan et al. | 134/10 |
| 6,250,314 | B1 | * | 6/2001 | Wasserbauer et al. | 134/3 |
| 2002/0174880 | A1 | * | 11/2002 | Madi et al. | 134/3 |
| 2002/0175129 | A1 | * | 11/2002 | Madi et al. | 210/766 |
| 2002/0179113 | A1 | * | 12/2002 | Madi et al. | 134/3 |

* cited by examiner

Electrical Steel Pickling Using Hydrogen Peroxide
Figure 1 : Three Tanks Arrangement
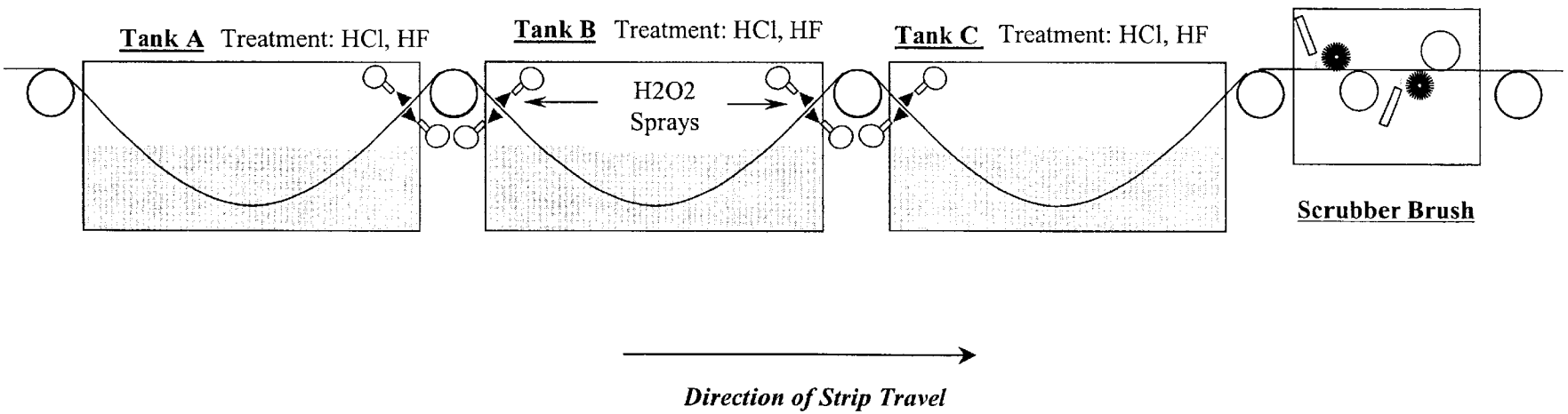

Electrical Steel Pickling Using Hydrogen Peroxide
Figure 2 : Two Tanks Arrangement
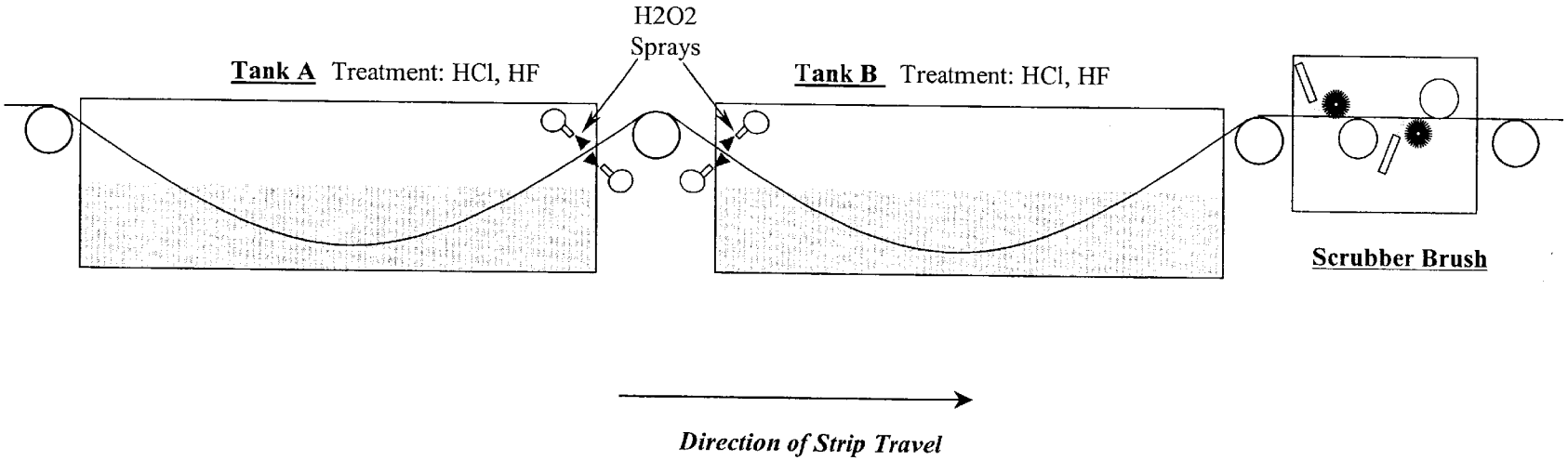

Electrical Steel Using Hydrogen Peroxide
Figure 3 : Single Tank Arrangement
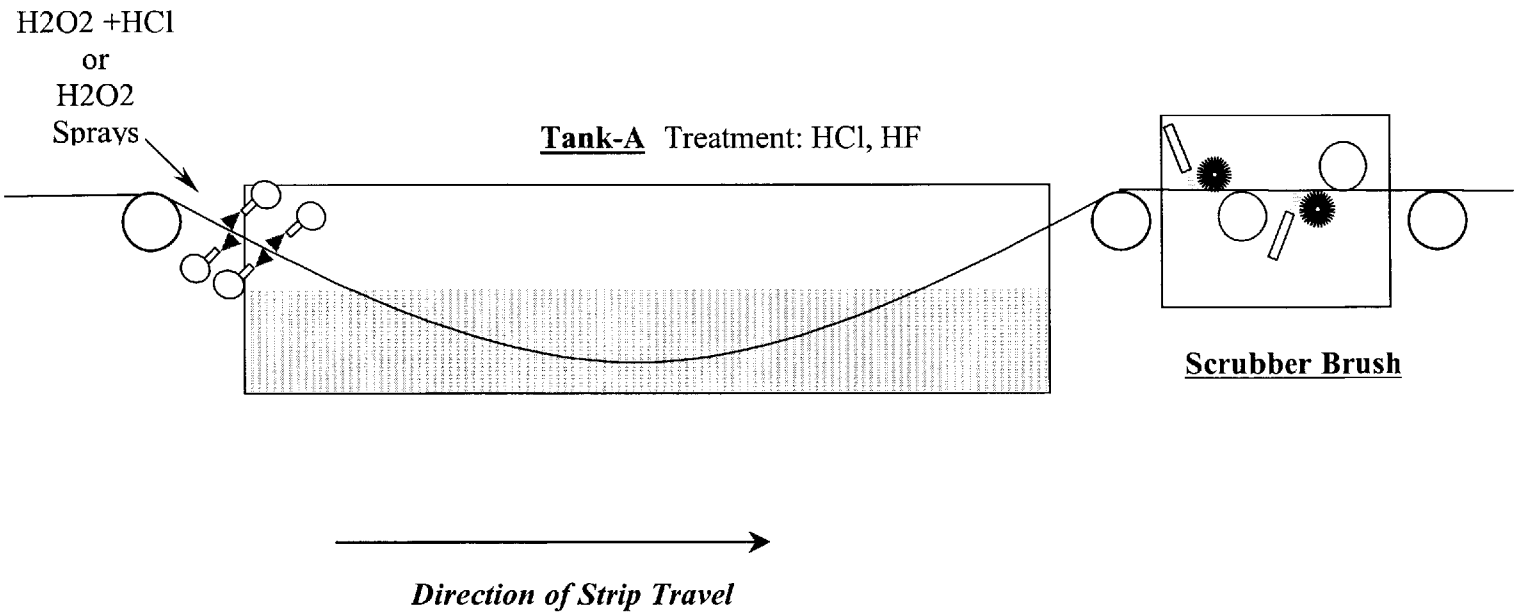

HYDROGEN PEROXIDE PICKLING SCHEME FOR SILICON-CONTAINING ELECTRICAL STEEL GRADES

This application is based on and claims the benefit of U.S. provisional Patent Application Ser. No. 60/282,564, Vijay N. Madi, Jerald W. Leeker, Clayton A. Van Scoy, filed Apr. 9, 2001.

FIELD OF INVENTION

This invention relates to a process for pickling electrical steel. More particularly, this invention relates to a method for pickling silicon-containing electrical steel strip using hydrogen peroxide.

BACKGROUND

Silicon-containing electrical steels are low carbon (from about 0.1% or less) specialty steels typically containing from about 0.5% to about 3.5% silicon. These steels include grain oriented and non-oriented steels. Hot processing of silicon-containing electrical steels can result in the formation of oxides on the surface of the steel strip. These oxides are primarily comprised of iron, silicon, and other associated metals, which must be removed prior to cold reduction and other subsequent processing. Traditionally, these oxides have been removed by an initial mechanical treatment such as shot blasting, which is followed by a chemical treatment such as pickling with nitric acid, or, nitric acid in combination with hydrochloric acid and hydrofluoric acid.

There is a desire for a method of pickling electrical steels that eliminates the use of nitric acid.

SUMMARY OF THE INVENTION

The present invention relates to a process for pickling silicon-containing electrical steel strip. The pickling process comprises of plurality of pickling tanks containing hydrochloric and hydrofluoric acids along with hydrogen peroxide sprayers located between the pickling tank treatments. The sprayers are located above the solution contained in the pickling tanks and the spray solution comprises an aqueous solution of hydrogen peroxide. The process comprises of continuous multiple treatments of immersing the steel strip in a pickling tank and then spraying the top and bottom surfaces of the steel strip with the spray solution as it exits the pickle tank and before it enters the next pickle tank. Upon exiting the last pickling tank, the strip is brushed/scrubbed.

This process may also comprise of a single pickling tank containing hydrochloric and hydrofluoric acids along with the hydrogen peroxide sprayers located the strip entry in to the pickling tank. The sprayers are located above the solution contained in the pickling tank and the spray solution comprises an aqueous solution of hydrogen peroxide or an acidified aqueous solution of hydrogen peroxide.

BRIEF DESCRIPTION OF THE DRAWINGS

FIG 1: Pickling tank arrangement showing electrical steel strip traveling through three pickling tanks equipped with hydrogen peroxide sprayers, followed by a scrubber brush machine.

FIG. 2: Pickling tank arrangement showing electrical steel strip traveling through two pickling tanks equipped with hydrogen peroxide sprayers, followed by a scrubber brush machine.

FIG. 3: Pickling tank arrangement showing electrical steel strip traveling through one pickling tank equipped with hydrogen peroxide sprayers, followed by a scrubber brush machine.

DESCRIPTION OF INVENTION

The present invention relates to a process for pickling silicon-containing electrical steel strip, which employs a continuous pickle line or anneal and pickle line, wherein the pickling solution comprises a mixture of hydrofluoric and hydrochloric acids followed by treating the strip with an aqueous spray solution comprising hydrogen peroxide. The electrical steels may contain from about 0.5% to about 4% silicon.

The pickling process of the present invention is designed for pickling electrical steel strip in a continuous fashion and comprises at least one pickling tank equipped with at least one set of sprayers designed to spray the top and bottom surfaces of a steel strip with a solution comprised of hydrogen peroxide. The surface treatment sprayers are above the level of the pickle bath solution. Once the steel strip has passed through the pickling tank(s), it is subsequently treated with a scrubber brush machine. At least one, preferably at least two, and most preferably at least three, pickling tanks are employed (see FIGS. 1–3). When only one pickling tank is employed, the sprayers are positioned so as to treat the steel strip surface before the pickling treatment in the pickle tank (see FIG. 3). When more than one pickle tank is employed, the sprayers are positioned to treat the steel strip surface in between the pickling treatment in the pickle tanks (see FIGS. 1 and 2).

In all of the embodiments, the pickling tanks comprise a mixture of hydrochloric acid and hydrofluoric acid at elevated temperatures. In one embodiment, the concentration of hydrochloric acid range from about 40 g/l to about 160 g/l. In a further embodiment, the concentration of hydrochloric acid is from about 100 g/l to about 120 g/l. In one embodiment, the concentration of hydrofluoric acid ranges from about 20 g/l to about 110 g/l. In another embodiment, the concentration of hydrofluoric acid is from about 30 g/l to about 50 g/l. The solutions in the tanks are maintained at a temperature of about 65° C. to about 95° C., with a preferred temperature of about 80° C. The concentration of the hydrogen peroxide spray solution is from about 20 g/l to about 60 g/l. In another embodiment, the concentration of hydrogen peroxide is about 30 g/l to about 50 g/l. The hydrogen peroxide spray solution is used at ambient temperatures. In an additional embodiment, the spray solution comprises an aqueous mixture of hydrogen peroxide and hydrochloric acid, wherein the concentration of hydrogen peroxide is from about 20 g/l to about 60 g/l and the concentration of hydrochloric is from about 40 g/l to about 160 g/l. In a further embodiment, the concentration of hydrogen peroxide is from about 30 g/l to about 50 g/l and the concentration of hydrochloric is from about 100 g/l to about 120 g/l.

In one embodiment, the pickling process of the present invention is comprised of three pickling tanks containing pickling solutions which are comprised of a mixture of hydrochloric and hydrofluoric acids (Tank A, Tank B, and Tank C in FIG. 1). The hydrogen peroxide solution sprayers are located in between the pickling treatments of Tanks A and B and Tanks B and C. In this embodiment, a scrubber-brush machine is placed after Tank C. In the embodiments that utilize one or two sets of sprayers, the spray solution comprises an aqueous solution of hydrogen peroxide.

When two pickling tanks are used, the hydrogen peroxide sprayers are located in between the pickling treatments. In one embodiment, sprayers are located at the exit of Tank A and the entrance of Tank B (see FIG. 2).

When only one pickling tank is used (FIG. 3), the sprayers are located at the entrance of the pickling tank. The spray solution may comprise an aqueous solution of hydrogen peroxide or comprise an aqueous solution of hydrogen peroxide and hydrochloric acid. The hydrogen peroxide is in a concentration from about 20 g/l to about 60 g/l, with a preferred concentration of about 30 g/l to about 50 g/l. The hydrochloric acid is in a concentration from about 40 g/l to about 160 g/l, with a preferred concentration of about 100 g/l to about 120 g/l.

EXAMPLE

The following hot rolled electrical steels are processed on a continuous anneal pickle line. Before pickling, the steel is annealed at proper temperature depending on the alloy and then mechanically de-scaled using a steel shot blasting device. The sprayers are positioned at the exit end of Tanks A and B and entry end of Tanks B and C. The strip surface is also subjected to scrubbing and rinsing after Tank C. This process produces quality steel at production rates comparable to pickling systems which use nitric acid.

| Electrical | TANK-3 | | | TANK-2 | | | TANK-1 | | | Sprays |
|---|---|---|---|---|---|---|---|---|---|---|
| Steel Type & % Si | HCl G/l | HF g/l | Temp. Deg. C. | HCl g/l | HF g/l | Temp. Deg. C. | HCl g/l | HF g/l | Temp. Deg. C. | $H_2O_2$ g/l |
| Non-Oriented (1.6–2.0 % Si) | 155 | 95 | 77 | 145 | 35 | 79 | 156 | 38 | 77 | 30 |
| | 125 | 72 | 77 | 111 | 44 | 79 | 113 | 47 | 77 | 30 |
| Grain Oriented (3.0–3.5 % Si) | 138 | 97 | 77 | 121 | 68 | 77 | 123 | 65 | 75 | 30 |
| | 156 | 95 | 77 | 150 | 34 | 77 | 146 | 35 | 76 | 30 |

What is claimed is:

1. A process for pickling electrical steel strip in a continuous fashion comprising the steps of:

a. spraying top and bottom surfaces of said strip with a spray solution from sprayers, prior to said strip being immersed in a solution contained in a first pickling tank, and the spray solution comprises an aqueous solution of hydrogen peroxide;

b. immersing said strip into the solution contained in the first pickling tank, said solution comprising hydrochloric acid and hydrofluoric acid; and c. brushing said strip to loosen any residual scale.

2. The process of claim 1 wherein prior to spraying with the first set of sprayers, said strip is immersed in a solution contained in a second pickling tank, said solution comprising hydrochloric acid and hydrofluoric acid.

3. The process of claim 1 wherein said spray solution further comprises an aqueous solution of hydrogen peroxide and hydrochloric acid.

4. The process of claim 2 wherein prior to immersing said strip in the second pickling tank said strip is immersed in a solution contained in a third pickling tank, said solution comprising hydrochloric acid and hydrofluoric acid.

5. The process of claim 3 wherein the concentration of the hydrogen peroxide is from about 20 g/l to about 60 g/l and the concentration of hydrochloric acid is from about 40 g/l to about 160 g/l.

6. The process of claim 4 wherein upon exiting the solution contained in the third pickling tank, the top and bottom surfaces of said strip are sprayed with the solution from said sprayers and the spray solution comprises said aqueous solution of hydrogen peroxide.

7. The process of claim 5 wherein the concentration of the hydrogen peroxide is from about 40 g/l to about 50 g/l and the concentration of hydrochloric acid is from about 100 g/l to about 120 g/l.

8. The process of claim 6 wherein the solution in all pickling tanks contains from about 40 g/L to about 160 g/L of hydrochloric acid and from about 20 g/L to about 110 g/L of hydrofluoric acid.

9. The process of claim 6 wherein the concentration of the hydrogen peroxide used in all sprayers is from about 20 g/L to about 60 g/L.

10. The process of claim 6 wherein said spray solution further comprises an aqueous solution of hydrogen peroxide and hydrochloric acid.

11. The process of claim 8 wherein the aqueous solution in all pickling tanks contains from about 100 g/L to about 120 g/L of hydrochloric acid and from about 30 g/L to about 50 g/L of hydrofluoric acid.

12. The process of claim 8 wherein the solution in the pickling tanks is maintained at a temperature of from about 65° C. to about 95° C.

13. The process of claim 9 wherein the concentration of the hydrogen peroxide used in all sprayers is from about 30 g/L to about 50 g/L.

14. The process of claim 10 wherein the concentration of the hydrogen peroxide is from about 20 g/l to about 60 g/l and the concentration of hydrochloric acid is from about 40 g/l to about 160 g/l.

15. The process of claim 12 wherein the temperature of the solution in the pickling tanks is about 80° C.

16. The process of claim 14 wherein the concentration of the hydrogen peroxide is from about 40 g/l to about 50 g/l and the concentration of hydrochloric acid is from about 100 g/l to about 120 g/l.

17. A process for pickling electrical steel strip in a continuous fashion comprising the sequential steps of:

a. immersing said strip into a solution contained in an initial pickling tank, wherein said solution comprises from about 40 g/L to about 160 g/L hydrochloric acid and from about 20 g/L to about 110 g/L hydrofluoric acid, and wherein said solution is maintained at a temperature of from about 65° C. to about 95° C.;

b. spraying top and bottom surfaces of said strip with sprayers after step (a) and prior to immersing said strip into an additional pickling tank, wherein said strip is sprayed with an aqueous solution comprising from about 20 g/L to about 60 g/L of hydrogen peroxide;

c. immersing said strip into a solution contained in said additional pickling tank, wherein said solution comprises from about 40 g/L to about 160 g/L hydrochloric acid and from about 20 g/L to about 110 g/L hydrofluoric acid, and wherein said solution is maintained at a temperature of from about 65° C. to about 95° C.;

d. spraying top and bottom surfaces of said strip with sprayers after step (c) and prior to immersing said strip into a final pickling tank, wherein said strip is sprayed with an aqueous solution comprising from about 20 g/L to about 60 g/L of hydrogen peroxide;

e. immersing said strip into a solution contained in said final pickling tank, wherein said solution comprises from about 40 g/L to about 160 g/L hydrochloric acid and from about 20 g/L to about 110 g/L hydrofluoric acid, and wherein said solution is maintained at a temperature of from about 65° C. to about 95° C.; and f. brushing said strip to loosen any residual scale thereby forming a clean strip.

18. A process for pickling electrical steel strip comprising the sequential steps of:

a. spraying top and bottom surfaces of said strip with sprayers prior to said strip being immersed in a solution contained in a pickling tank, wherein said spray solution comprises an aqueous solution of hydrogen peroxide and hydrochloric acid, and the concentration of the hydrogen peroxide used in the sprayer is from about 20 g/l to about 60 g/l and the concentration of hydrochloric acid is from about 40 g/l to about 160 g/l;

b. immersing said strip into the solution contained in the pickling tank, wherein said solution comprises from about 40 g/L to about 160 g/L hydrochloric acid and from about 20 g/L to about 110 g/L hydrofluoric acid, and wherein the temperature of said solution in the pickling tank is from about 65° C. to about 95° C.; and c. brushing said strip to loosen any residual scale thereby forming a clean strip.

* * * * *